United States Patent [19]

Nagatori

[11] Patent Number: 4,928,969

[45] Date of Patent: May 29, 1990

[54] ARROWHEAD

[76] Inventor: Wesley S. Nagatori, P.O. Box 845, Captain Cook, Hi. 96704

[21] Appl. No.: 390,982

[22] Filed: Aug. 7, 1989

[51] Int. Cl.[5] ..... F41B 5/02

[52] U.S. Cl. ..... 273/422

[58] Field of Search ..... 273/422, 421

[56] References Cited

U.S. PATENT DOCUMENTS

| | | | |
|---|---|---|---|
| 2,289,284 | 7/1942 | Chanoler | 273/422 |
| 2,909,372 | 10/1959 | Neri | 273/422 |
| 3,614,103 | 10/1971 | Carroll | 273/422 |
| 3,741,542 | 6/1973 | Karbo | 273/422 |
| 4,029,319 | 6/1977 | Christen . | |
| 4,143,876 | 3/1979 | Henkel | 273/422 |
| 4,341,391 | 7/1982 | Anderson . | |
| 4,349,202 | 9/1982 | Scott . | |
| 4,452,459 | 6/1984 | Doonan . | |
| 4,468,038 | 7/1984 | Saunders . | |
| 4,558,868 | 12/1985 | Musacchia | 273/422 |
| 4,570,941 | 2/1986 | Saunders | 273/422 |
| 4,616,835 | 10/1986 | Trotter | 273/421 |
| 4,643,435 | 2/1987 | Musacchia | 273/422 |

*Primary Examiner*—Paul E. Shapiro

*Attorney, Agent, or Firm*—Leon Gilden

[57] ABSTRACT

An arrowhead construction is set forth wherein a primary arrow is formed with a replaceable secondary arrow received within a slot of the primary arrow, and wherein the aforenoted assembly is received within a slotted ferrule. The ferrule is threadedly mounted and received within an insert positioned within an arrow shaft.

8 Claims, 4 Drawing Sheets

ARROWHEAD

BACKGROUND OF THE INVENTION

1. Field of the Invention

The field of invention relates to arrowheads, and more particularly pertains to a new and improved arrowhead provided with replaceable secondary arrowhead inserts mountable within an arrow shaft.

2. Description of the Prior Art

The use of arrowheads of various configurations for assembly to shafts is well known in the prior art The prior art has heretofore utilized arrows of multiple and complex configuration to accommodate various arrow shafts. Various devices have further been utilized for positioning the blades in a similar relationship, but have typically been of complex and relatively costly manufacturing costs and arrangements. Further, the removal of such arrowheads from targets has frequently been difficult, wherein the instant invention attempts to overcome the prior in providing an improved, relatively removable arrowhead in association with an arrow shaft. Examples of the prior art include U.S. Pat. No. 4,029,319 to Christen incorporated herein by reference as a typical example of the prior art utilizing an arrow shaft provided with an insert threadedly receiving a collet in turn securing a plurality of arrowheads to the collet arranged at ninety degree angles relative to one another.

U.S. Pat. No. 4,468,038 to Saunders illustrates the use of plural pairs of arrow sub-assemblies securable together to provide an arrowhead arrangement securable to the shaft of an arrow.

U.S. Pat. No. 4,349,202 to Scott provides an arrowhead assembly wherein a plurality of arrowheads are securable together orthogonally relative to one another and received within a core threadedly mounted to the shaft of an arrow.

U.S. Pat. No. 4,341,391 to Anderson provides the use of an arrow with a rearwardly threaded shank securable to an arrow shaft.

U.S. Pat. No. 4,452,459 to Doonan provides an arrowhead with a rearwardly mounted shaft threadedly mounted within an arrow body wherein a primary blade holds a secondary blade on a cylindrical shaft of the primary arrowhead and is provided with lock tabs to engage a rear surface of the shafts for securement of the arrowheads together.

As such, it may be appreciated that there is a continuing need for a new and improved arrowhead assembly wherein the same addresses both the problems of effectiveness in construction and ease of use, and in this respect, the present invention substantially fulfills this need.

SUMMARY OF THE INVENTION

In view of the foregoing disadvantages inherent in the known types of arrowheads now present in the prior art, the present invention provides an arrowhead wherein the same utilizes a primary and secondary blade received within a collet wherein the primary blade is threadedly mounted within an arrow shaft. As such, the general purpose of the present invention, which will be described subsequently in greater detail, is to provide a new and improved arrowhead which has all the advantages of the prior art arrowheads and none of the disadvantages.

To attain this, the present invention essentially includes a first blade provided with an enclosed slot receiving a second blade formed with a forward slot and a rear positioning stem axially aligned with the secondary blade, and wherein the primary blades includes a rearwardly extending axial shaft receivable within a slotted ferrule, wherein securement of the threaded shank of the rearwardly extending shaft of the primary blade is threadedly received with an arrowhead, wherein the ferrule imposes upon the secondary blade to lock the secondary blade relative to the primary blade.

My invention resides not in any one of these features per se. but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved arrowhead which has all the advantages of the prior art arrowheads and none of the disadvantages.

It is another object of the present invention to provide a new and improved arrowhead which may be easily and efficiently manufactured and marketed.

It is a further object of the present invention to provide a new and improved arrowhead which is of a durable and reliable construction.

An even further object of the present invention is to provide a new and improved arrowhead which is susceptible of a low cost of manufacture with regard to both materials and labor, and which accordingly is then susceptible of low prices of sale to the consuming public, thereby making such arrowheads economically available to the buying public.

Still yet another object of the present invention is to provide a new and improved arrowhead which provides in the apparatuses and methods of the prior art some of the advantages thereof, while simultaneously overcoming some of the disadvantages normally associated therewith.

Still another object of the present invention is to provide a new and improved arrowhead wherein the same utilizes a primary blade and a secondary blade receivable within a primary blade, and relative securement of the organization within an arrowhead shaft locks the primary blade relative to the secondary blade.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
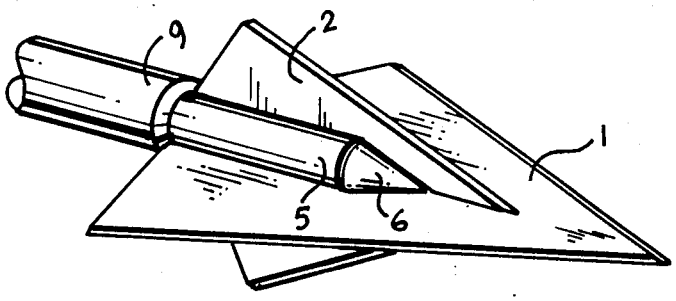
FIG. 1 is an isometric illustration of the prior art.

With reference now to the drawings, and in particular FIGS. 1 to 10 thereof, a new and improved arrowhead embodying the principles and concepts of the present invention and generally designated by the reference numeral 10 will be described.

Figure 2:
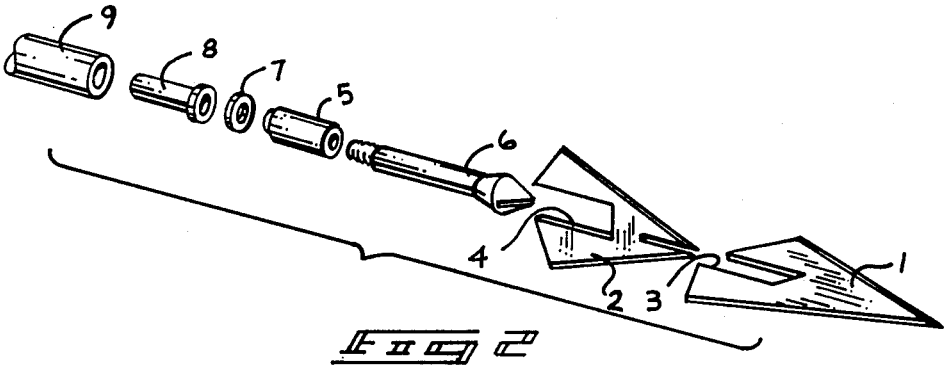
FIG. 2 is an isometric exploded illustration, exploded, of the prior art.
Figure 3:
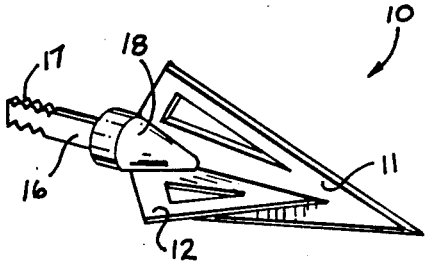
FIG. 3 is an isometric illustration of the instant invention.

More specifically, the arrowhead 10 of the instant invention essentially comprises an improvement of the prior art as illustrated in FIGS. 1 and 2, wherein the prior art utilizes a first blade formed 1 with a first recess 3 and a second blade 2 formed with a second recess, wherein the recesses receive a sleeve 5 cooperative against an associated collet 6 formed with a forward conical split portion to be received within the first and second recesses with an impact ring 7 separating the collet from an internally threaded insert 8 mounted within an associated arrow shaft 9 whereupon relative rotation of the collet relative to the insert secures the first and second blades together. It should be noted that the primary blade is of a delta configuration terminating in a forward apex and wherein the secondary blade is also of a delta configuration but formed with a blunt apex with an axial slot 21 bisecting the forward blunt apex. The arrowhead 10, as illustrated in FIG. 3, utilizes a primary blade mounting a secondary blade 12 therewithin. The primary blade 11 is formed with a first and second triangular stability slot 14 and accordingly, the secondary blade 12 utilizes a plurality of second triangular stability slots 15, wherein each of the pairs of triangular stability slots are positioned symmetrically about an axis or center line of each of the respective primary and secondary blade members 11 and 12. The primary blade 11 is formed with an enclosed slot 13 positioned medially of the first triangular stability slots 14 and coaxially aligned with the center line of the primary blade 11, wherein the enclosed slot 13 is of a length to receive the secondary blade 12 therewithin. The primary blade 11 is provided with a coaxially and rearwardly extending axial shaft 16 formed with a threaded rear portion 17. The threaded rear portion 17 is arranged for threaded engagement within a typical arrowhead shaft 9 which may include a conventional internally threaded insert 18, as illustrated in FIG. 2.

Figure 4:
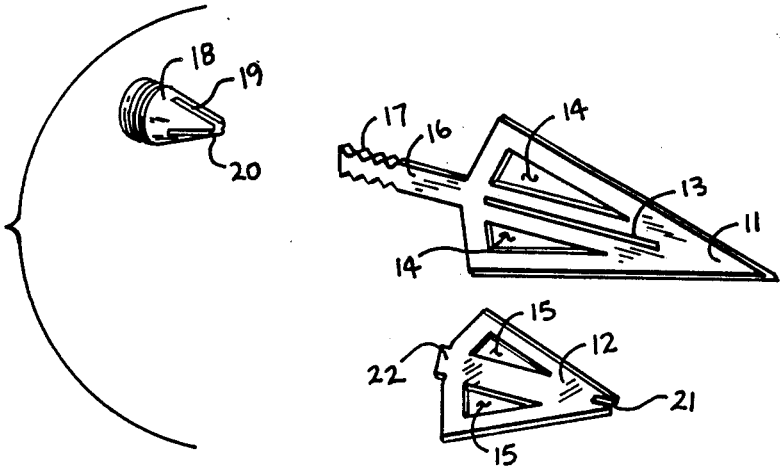
FIG. 4 is an isometric illustration of the instant invention, somewhat expanded.
Figure 5:
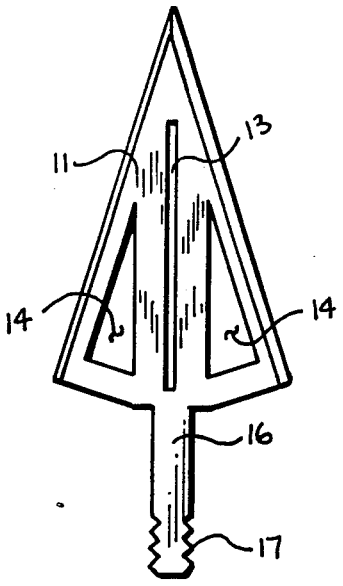
FIG. 5 is an orthographic view taken in elevation of the primary arrowhead blade.
Figure 6:
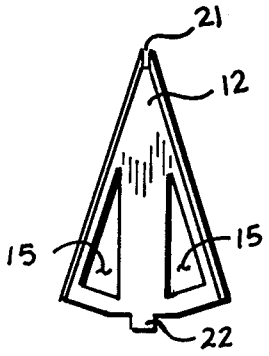
FIG. 6 is an orthographic view taken in eIevation of the secondary arrowhead blade.
Figure 7:
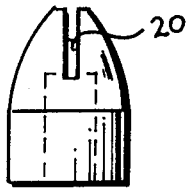
FIG. 7 is a first orthographic view of the ferrule utilized by the instant invention.
Figure 8:
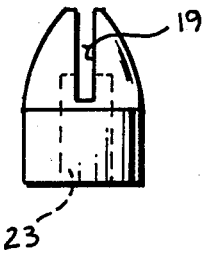
FIG. 8 is a further orthographic view taken in elevation rotated ninety degrees relative to the illustration as set forth in FIG. 7.
Figure 9:
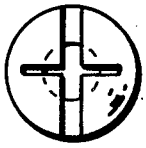
FIG. 9 is a top orthographic view of the ferrule of the instant invention.
Figure 10:
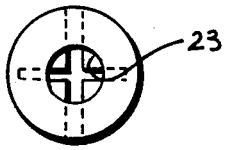
FIG. 10 is a bottom orthographic view of the ferrule of the instant invention.

The slotted ferrule 18, as illustrated in FIGS. 7 through 10 as well as FIG. 4, is formed with a conical forward nose and a cylindrical body with a ferrule bore 23 extending through the cylindrical body and into the forward conical nose at a predetermined distance to be further defined below. The conical nose includes a plurality of axial slots formed with a primary blade slot 19 of a first length and a secondary blade slot 20 of a second length less than that of the first length, wherein the lowermost edge of the secondary blade slot extends below the forwardmost extent of the ferrule bore 23 within the conical nose. As may be appreciated, the secondary blade 12 is inserted within the slot 13 of the primary blade, wherein the axial shaft 16 is of a width substantially equal to the diameter of the ferrule bore 23 to extend therethrough with the positioning stem 22 of the secondary blade coaxially aligned with the secondary blade, also a diameter substantially equal to the bore 23, whereupon threaded engagement of the threaded rear portion 17 within the arrow shaft 9 forces a forward portion of the arrow shaft 9 against the rear edge of the positioning stem 22 and forces a forward axial slot 21 formed within the apex of the secondary blade 11 into engagement with the forward end of the enclosed slot 13 and locks the secondary blade within the primary blade.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of &he principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An arrowhead assembly comprising, a primary delta shaped blade formed with an elongate axial slot and a secondary delta shaped blade receivable within the axial slot orthogonally relative to the primary blade, and the primary blade including an elongate axially aligned rearwardly extending shaft wherein the secondary blade includes a positioning stem extending axially rearwardly of the secondary blade of a second length less than that defined by a first length of the extending shaft, and a ferrule including orthogonally arranged first and second bisecting slots formed through a forward end of the ferrule to receive and align the primary and secondary blades relative to one another.

2. An arrowhead assembly as set forth in claim 1 wherein the axial slot is completely enclosed within the primary blade.

3. An arrowhead assembly as set forth in claim 2 wherein the secondary blade includes a blunt forward tip including a forward axial slot bisecting the blunt forward tip, the bisecting slot arranged to engage a forward end of the enclosed slot.

4. An arrowhead assembly as set forth in claim 3 wherein the rearwardly extending shaft of &he primary blade includes a threaded portion formed at a rearward end thereof, the threaded portion arranged for threaded reception within a forward end of an arrow shaft.

5. An arrowhead assembly as set forth in claim 4 wherein the first slot of the ferrule is of a first slot length and the second slot is of a second slot length, wherein the second slot length is less than the first slot length and the second slot length receives the secondary blade and the first slot length receives the primary blade, wherein the primary blade receives the secondary blade therewithin, and the secondary blade is positioned within the ferrule.

6. An arrowhead assembly as set forth in claim 5 wherein the ferrule includes a ferrule bore directed rearwardly of the ferrule and axially thereof and extending forwardly a bore length to extend above a lowermost end of the second slot to enable the arrowhead shaft to engage the positioning stem and force the secondary blade forwardly within the enclosed slot.

7. An arrowhead assembly as set forth in claim 6 wherein the primary blade includes a plurality of triangular stability slots symmetrically positioned about the enclosed slot, and the secondary blade includes a plurality of further triangular stability slots positioned symmetrically about the secondary blade.

8. An arrowhead assembly as set forth in claim 7 wherein the rearwardly extending shaft of the primary blade and the positioning stem of the secondary blade are of a width substantially equal to a diameter defined by the bore.

* * * * *